US011848523B2

(12) United States Patent
Yang et al.

(10) Patent No.: US 11,848,523 B2
(45) Date of Patent: Dec. 19, 2023

(54) CONNECTOR HOUSING ASSEMBLY

(71) Applicants: Tyco Electronics (Shanghai) Co. Ltd., Shanghai (CN); TE Connectivity Services GmbH, Schaffhausen (CH)

(72) Inventors: Hongwen Yang, Shanghai (CN); Hongqiang Han, Shanghai (CN); Richard James Long, Middletown, PA (US); Alex Michael Sharf, Middletown, PA (US)

(73) Assignees: TE Connectivity Solutions GmbH, Schaffhausen (CH); Tyco Electronics (Shanghai) Co., Ltd., Shanghai (CN)

( * ) Notice: Subject to any disclaimer, the term of this patent is extended or adjusted under 35 U.S.C. 154(b) by 178 days.

(21) Appl. No.: 17/361,589

(22) Filed: Jun. 29, 2021

(65) Prior Publication Data

US 2021/0408735 A1 Dec. 30, 2021

(30) Foreign Application Priority Data

Jun. 30, 2020 (CN) ..... 202010615809.0

(51) Int. Cl.
*H01R 13/6585* (2011.01)
*H01R 13/514* (2006.01)

(52) U.S. Cl.
CPC ..... *H01R 13/6585* (2013.01); *H01R 13/514* (2013.01)

(58) Field of Classification Search
CPC ..... H01R 13/6585; H01R 13/514; H01R 13/6272; H01R 13/6586; H01R 13/6582; H01R 13/6581
See application file for complete search history.

(56) References Cited

U.S. PATENT DOCUMENTS 7,530,845 B1 * 5/2009 Yang ..... G02B 6/4201 439/607.01
7,641,515 B1 * 1/2010 Szczesny ..... H01R 13/6582 439/541.5
7,704,097 B1 4/2010 Phillips et al.
(Continued)

FOREIGN PATENT DOCUMENTS

CN 101924304 A 12/2010
CN 105445859 A 3/2016
(Continued)

OTHER PUBLICATIONS

Chinese Office Action dated May 31, 2023, with English translation, corresponding to Application No. 202010615809.0, 13 pages.

*Primary Examiner* — Truc T Nguyen
(74) *Attorney, Agent, or Firm* — Barley Snyder

(57) ABSTRACT

A connector housing assembly comprises a housing defining an accommodation space having a left side wall and a right side wall opposite to each other in a transverse direction of the housing. A partition member is inserted into the accommodation space for dividing the accommodation space into an upper insertion chamber and a lower insertion chamber. A shielding member is installed within the partition member and includes elastic contacts extending from lateral sides of the partition member for pressing on the left and right side walls of the accommodation space.

20 Claims, 4 Drawing Sheets

(56) References Cited

U.S. PATENT DOCUMENTS

| | | | | |
|---|---|---|---|---|
| 7,896,659 | B1 * | 3/2011 | Westman | H01R 13/6595 439/607.25 |
| 8,460,029 | B1 * | 6/2013 | Chen | H01R 13/659 439/540.1 |
| 9,547,141 | B2 | 1/2017 | Wu et al. | |
| 9,728,919 | B1 | 8/2017 | Dunwoody et al. | |
| 9,812,833 | B2 | 11/2017 | Chen | |
| 11,108,200 | B2 | 8/2021 | Wang et al. | |
| 11,355,884 | B2 | 1/2022 | Yang | |
| 11,598,803 | B1 * | 3/2023 | Cao | G01R 31/2822 |
| 2006/0003632 | A1 * | 1/2006 | Long | H01R 13/659 439/607.2 |
| 2006/0030221 | A1 * | 2/2006 | Hyland | H01R 24/64 439/676 |
| 2007/0197060 | A1 * | 8/2007 | Wang | H01R 13/6593 439/92 |
| 2008/0171469 | A1 * | 7/2008 | Phillips | H01R 13/659 439/607.01 |
| 2008/0299828 | A1 * | 12/2008 | Gu | H01R 13/6582 439/607.01 |
| 2010/0221950 | A1 | 9/2010 | Pepe et al. | |
| 2010/0267255 | A1 * | 10/2010 | Mo | H01R 13/6658 439/74 |
| 2015/0024614 | A1 * | 1/2015 | Gao | H01R 13/6581 439/78 |
| 2017/0264052 | A1 * | 9/2017 | Henry | H01R 13/6596 |
| 2018/0062298 | A1 * | 3/2018 | Mogi | H01R 27/02 |
| 2018/0129000 | A1 * | 5/2018 | Liu | G02B 6/4292 |
| 2018/0358754 | A1 * | 12/2018 | Wei | H01R 13/6594 |
| 2021/0028580 | A1 * | 1/2021 | Yang | H01R 13/6581 |
| 2021/0408735 | A1 * | 12/2021 | Yang | H01R 13/6582 |

FOREIGN PATENT DOCUMENTS

| | | | |
|---|---|---|---|
| CN | 105720402 | A | 6/2016 |
| CN | 107634399 | A | 1/2018 |
| CN | 110867679 | A | 3/2020 |
| CN | 210779126 | U | 6/2020 |
| TW | M596469 | U | 6/2020 |

* cited by examiner

CONNECTOR HOUSING ASSEMBLY

CROSS-REFERENCE TO RELATED APPLICATIONS

This application claims priority under 35 U.S.C. § 119 to Chinese Patent Application No. 202010615809.0, filed Jun. 30, 2020, the entire disclosure of which is incorporated herein by reference.

FIELD OF THE INVENTION

The present disclosure relates to a connector housing assembly, and more specifically, to a connector housing assembly having improved electromagnetic shielding.

BACKGROUND

In embodiments of the prior art, an internal space of a housing of a laminated connector is divided into multiple rows and columns of insertion chambers by a plurality of vertical separation walls and a plurality of horizontal partition members. An elastic latch may be formed on each of the top wall and the bottom wall of the horizontal partition member. The elastic latch extends into the corresponding insertion chamber, so as to lock a mating connector inserted into the corresponding insertion chamber.

In the prior art, however, there is typically a gap formed between the side of the partition member and the side wall of the insertion chamber of the housing, which reduces the electromagnetic shielding performance of the connector. In addition, in the prior art, in order not to affect the range of movement of the elastic latch, a slot for avoiding the elastic latch is usually formed on each of the top wall and the bottom wall of the partition members, which further reduces the electromagnetic shielding performance of the connector.

SUMMARY

According to an embodiment of the present disclosure, a connector housing assembly comprises a housing defining an accommodation space having a left side wall and a right side wall arranged opposite each other in a transverse direction of the housing. A partition member is inserted into the accommodation space for dividing the accommodation space into an upper insertion chamber and a lower insertion chamber. A shielding member is installed within the partition member and includes elastic contacts extending from lateral sides of the partition member for pressing on the left and right side walls of the accommodation space.

BRIEF DESCRIPTION OF THE DRAWINGS

The invention will now be described by way of example with reference to the accompanying Figures, of which.

DETAILED DESCRIPTION OF THE EMBODIMENTS

Figure 1:
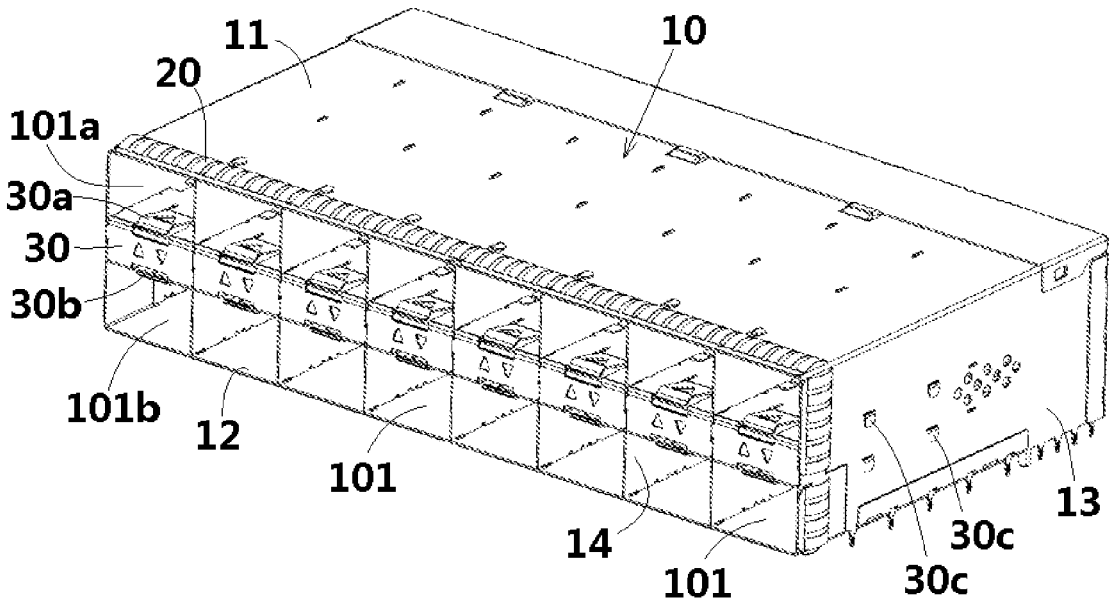
FIG. 1 is an illustrative perspective view of a connector housing assembly according to an exemplary embodiment of the present disclosure.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

According to an embodiment of the present disclosure, a connector housing assembly comprises a housing having at least one accommodation space, each of which has a left side wall and a right side wall opposite to each other in a transverse direction of the housing. At least one partition member is inserted into the at least one accommodation space along a longitudinal direction of the housing, and at least one shielding member is installed within the at least one partition member. Each partition member divides a corresponding accommodation space into an upper insertion chamber and a lower insertion chamber. Each shielding member has elastic contacts exposed from both sides of the partition member, and are pressed on or engaged with the left and right side walls of the accommodation space.

Figure 2:
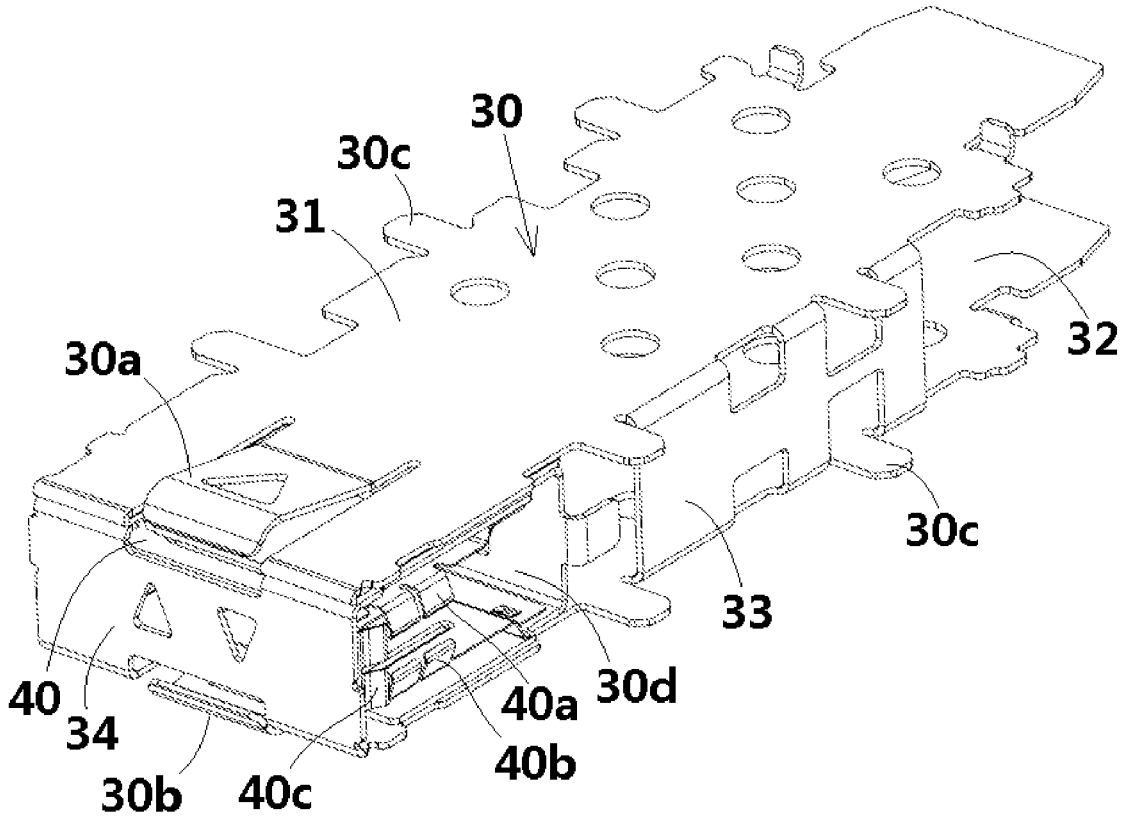
FIG. 2 is an illustrative perspective view of a partition member and a shielding member installed on the partition member according to an exemplary embodiment of the present disclosure.

FIG. 1 is an illustrative perspective view of a connector housing assembly according to an exemplary embodiment of the present disclosure. FIG. 2 is an illustrative perspective view of a partition member 30 and a shielding member 40 installed on or within the partition member 30 according to an exemplary embodiment of the present disclosure.

As shown in FIGS. 1-2, in an embodiment, the connector housing assembly generally comprises a housing 10, at least one partition member 30, and at least one shielding member 40. The housing 10 has at least one accommodation space 101. Each accommodation space 101 has a left side wall and a right side wall opposite to each other in a transverse direction of the housing 10. The partition members 30 are inserted into respective accommodation spaces 101 along a longitudinal direction of the housing 10. The shielding members 40 are installed within respective partition members 30.

Figure 3:
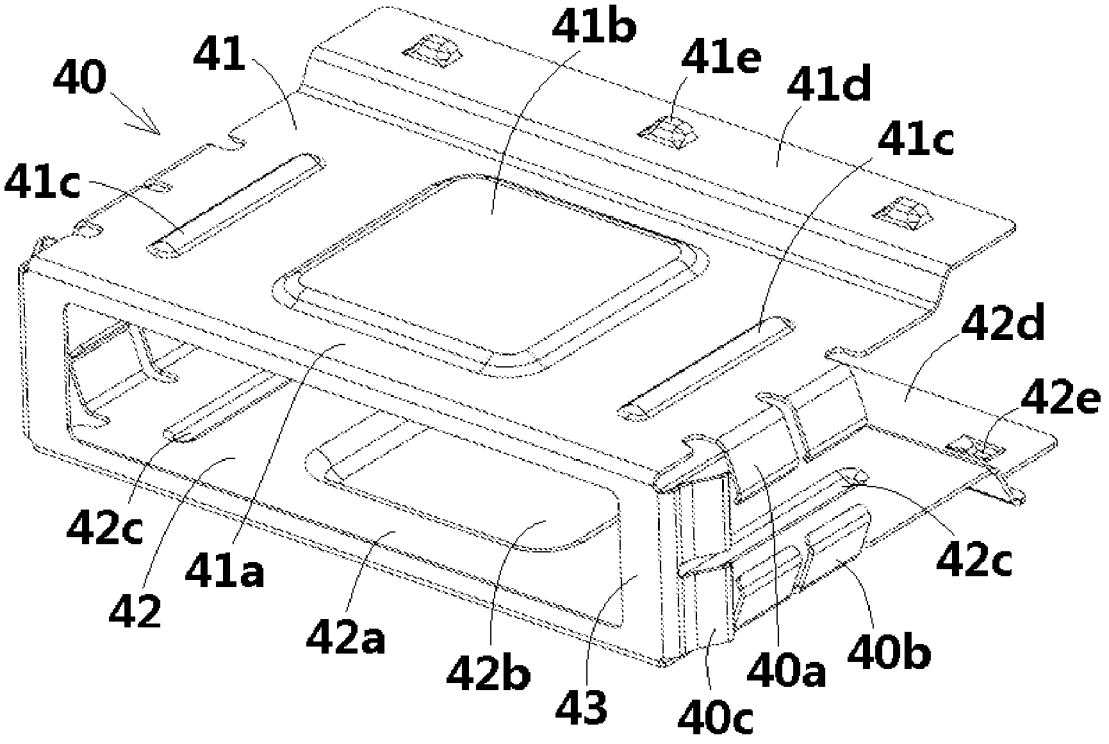
FIG. 3 is an illustrative perspective view of a shielding member of a connector housing assembly according to an exemplary embodiment of the present disclosure.
Figure 4:
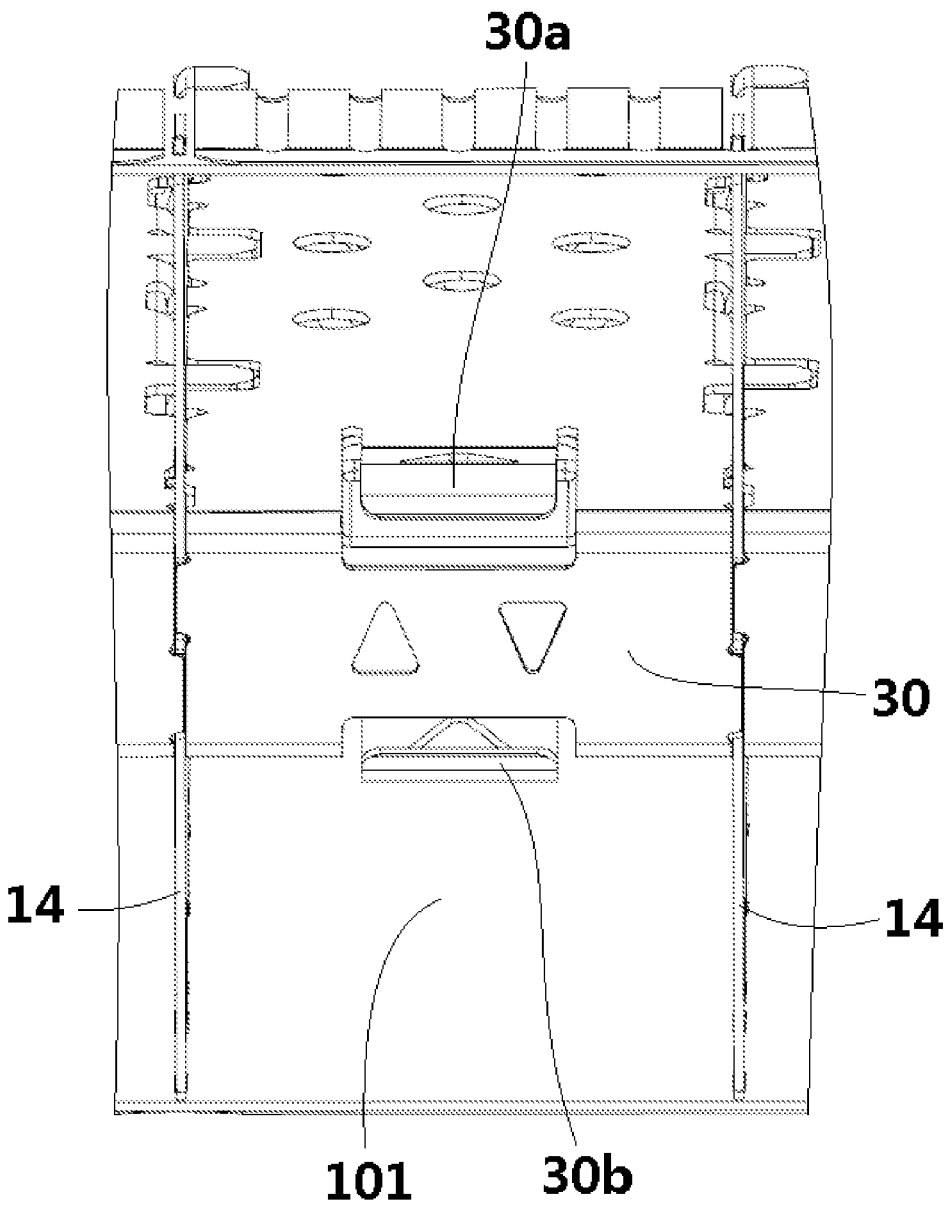
FIG. 4 is an illustrative partial plan view of a connector housing assembly according to an exemplary embodiment of the present disclosure.

FIG. 3 is an illustrative perspective view of a shielding member 40 of a connector housing assembly according to an exemplary embodiment of the present disclosure. FIG. 4 is an illustrative partial plan view of a connector housing assembly according to an exemplary embodiment of the present disclosure.

As shown in FIGS. 1-4, in an embodiment, each of the partition members 30 divide a corresponding accommodation space 101 into an upper insertion chamber 101*a* and a lower insertion chamber 101*b*. Each shielding member 40 has elastic contacts 40*a*, 40*b*, 40*c* exposed from both sides of the partition member 30. In an installed state, the elastic contacts 40*a*, 40*b*, 40*c* press on the left and right side walls of the accommodation space 101 respectively. In this way, the gap between the side of the partition member 30 and the side wall of the accommodation space 101 of the housing 10 may be sealed or minimized by the elastic contact of the shielding member, which improves the electromagnetic shielding performance of the connector.

As shown in FIGS. 1-4, in an embodiment, the partition member 30 includes a top plate 31, and the shielding member 40 includes a top wall 41 facing the top plate 31 of the partition member 30. A cantilever type upper latch 30*a* is formed on the top plate 31 of the partition member 30. The top wall 41 of the shielding member 40 is continuous, with no opening or slot provided thereon for avoiding or accommodating the upper latch 30*a*. In this way, the electromagnetic shielding performance of the connector is further improved.

As shown in FIGS. 1-4, in an embodiment, the partition member 30 includes a bottom plate 32, and the shielding member 40 includes a bottom wall 42 facing the bottom plate 32 of the partition member 30. A cantilever type lower latch 30*b* is formed on the bottom plate 32 of the partition member 30. Likewise, no opening or slot is formed for avoiding the lower latch 30*b* on the bottom wall 42 of the shielding member 40. In this way, the electromagnetic shielding performance of the connector may be further improved.

As shown in FIGS. 1-4, in an embodiment, the partition member 30 also includes a pair of side plates 33 at the left and right sides thereof, and a front side plate 34 at the front side thereof. An installation chamber 30*d* having left and right openings is defined among the top plate 31, the bottom plate 32 and the front side plate 34, the shielding member 40 is inserted into the installation chamber 30*d*, and the elastic contacts 40*a*, 40*b*, 40*c* are exposed from the left and right openings of the installation chamber 30*d*.

As shown in FIGS. 1-4, in an embodiment, the shielding member 40 also includes a front wall 43 at the front side thereof. The elastic contact 40*a*, 40*b*, 40*c* comprises a first elastic contact 40*a*, a second elastic contact 40*b* and a third elastic contact 40*c* respectively connected to edges of the front wall 43, the bottom wall 42 and the top wall 41 of the shielding member 40. As shown, each elastic contact 40*a*, 40*b*, 40*c* may define a pair of elastic tabs.

As shown in FIGS. 1-4, in an embodiment, the first elastic contact 40*a* seals a horizontally extending top gap between the top side of the partition member 30 and the side wall of the accommodation space 101. The second elastic contact 40*b* seals a horizontally extending bottom gap between the bottom side of the partition member 30 and the side wall of the accommodation space 101. The third elastic contact 40*c* seals a vertically extending front gap between the front side of the partition member 30 and the side wall of the accommodation space 101.

As shown in FIGS. 1-4, in an embodiment, an upper protrusion 41*b*, 41*c*, which protrudes toward the top plate 31 of the partition member 30, is formed on the top wall 41 of the shielding member 40. An area 41*a*, corresponding to a free end portion of the upper latch 30*a* of the top wall 41 is not protruded toward the top plate 31, so as to increase a distance between the free end portion of the upper latch 30*a* and the top wall 41, and to ensure that the free end portion of the upper latch 30*a* has enough free moving space. In this way, no opening or slot is required for avoiding the upper latch 30*a* on the top wall 41 of the shielding member 40, which improves the electromagnetic shielding performance of the connector.

As shown in FIGS. 1-4, in an embodiment, the upper latch 30*a* extends into the upper insertion chamber 101*a* and is suitable for locking a mating connector inserted into the upper insertion chamber 101*a*. During inserting the mating connector into the upper insertion chamber 101*a*, the mating connector pushes the free end portion of the upper latch 30*a* to move toward the top wall 41 of the shielding member 40.

As shown in FIGS. 1-4, in an embodiment, the upper protrusion 41*b*, 41*c* comprises a rectangular shaped first upper protrusion 41*b* and two bar shaped second upper protrusions 41*c* formed on the top wall 41. The first upper protrusion 41*b* is located at the middle of the top wall 41, and the two second upper protrusions 41*c* are respectively located at the left and right sides of the first upper protrusion 41*b*.

As shown in FIGS. 1-4, in an embodiment, the rear part 41*d* of the top wall 41 is bent to rise outwards, and bulges 41*e*, which protrude outwards and are adapted to contact with the top plate 31, are formed on the rear part 41*d* of the top wall 41.

As shown in FIGS. 1-4, in an embodiment, a lower protrusion 42*b*, 42*c*, which protrudes toward the bottom plate 32 of the partition member 30, is formed on the bottom wall 42 of the shielding member 40. An area 42*a*, corresponding to a free end portion of the lower latch 30*b*, of the bottom wall 42 is not protruded toward the bottom plate 32, so as to increase a distance between the free end portion of the lower latch 30*b* and the bottom wall 42, and to ensure that the free end portion of the lower latch 30*b* has enough free moving space. In this way, it does not need to from any slot for avoiding the lower latch 30*b* on the bottom wall 42 of the shielding member 40, which may improve the electromagnetic shielding performance of the connector.

As shown in FIGS. 1-4, in an embodiment, the lower latch 30*b* extends into the lower insertion chamber 101*b* and is suitable for locking a mating connector inserted into the lower insertion chamber 101*b*. While inserting the mating connector into the lower insertion chamber 101*b*, the mating connector pushes the end portion of the lower latch 30*b* to move toward the bottom wall 42 of the shielding member 40.

As shown in FIGS. 1-4, in an embodiment, the lower protrusion 42*b*, 42*c* comprises a rectangular first lower protrusion 42*b* and two bar shaped second lower protrusions 42*c* formed on the bottom wall 42. The first lower protrusion 42*b* is located at the middle of the bottom wall 42, and the two second lower protrusions 42*c* are respectively located at the left and right sides of the first lower protrusion 42*b*.

As shown in FIGS. 1-4, in an embodiment, the rear part 42*d* of the bottom wall 42 is bent to rise outwards, and bulges 42*e*, which protrude outwards and are adapted to contact with the bottom plate 32, are formed on the rear part 42*d* of the bottom wall 42.

As shown in FIGS. 1-4, in an embodiment, the partition member 30 includes a plurality of connecting tongues 30*c* extending outwards from the edges at the left and right sides of the top plate 31 and the bottom plate 32. The plurality of connecting tongues 30*c* are respectively inserted through holes formed in the left and right side walls of the accommodation space 101, and are bent and fixed on the left and right side walls of the accommodation space 101, so as to fix the partition member 30 to the housing 10.

As shown in FIGS. 1-4, in an embodiment, the housing 10 has a plurality of accommodation spaces 101, which are arranged in a row along the transverse direction of the housing 10. The connector housing assembly includes a plurality of partition members 30, which are arranged in a row along the transverse direction of the housing 10. The row of partition members 30 divides the row of accommodation spaces 101 of the housing 10 into a row of upper insertion chambers 101*a* and a row of lower insertion chambers 101*b*.

As shown in FIGS. 1-4, in an embodiment, the housing 10 comprises a top wall 11, a bottom wall 12, a pair of side walls 13 and at least one separation wall 14, the at least one separation wall 14 divides an internal space of the housing 10 into the plurality of accommodation spaces 101.

As shown in FIGS. 1-4, in an embodiment, the left and right side walls of the leftmost one or the rightmost one of the row of accommodation spaces 101 are composed of the side wall 13 and the separation plate 14 of the housing 10. The left and right side walls of one of the row of accommodation spaces 101 except the leftmost one and the rightmost one are composed of two separation walls 14 of the housing 10.

As shown in FIGS. 1-4, in an embodiment, the connector housing assembly also includes electromagnetic shielding spring tabs 20, which are mounted on four peripheral walls at the front side of the housing 10.

As shown in FIGS. 1-4, in an embodiment, each of the partition members 30 is an integrated component formed by punching or otherwise forming a single sheet metal plate. Each of the shielding members 40 is also an integrated punched component formed by punching a single sheet metal plate.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present disclosure are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A connector housing assembly, comprising:

a housing defining an accommodation space having a left side wall and a right side wall arranged opposite each other in a transverse direction of the housing;

a partition member inserted into the accommodation space and dividing the accommodation space into an upper insertion chamber and a lower insertion chamber, the partition member including:

a top plate;

a bottom plate; and a front plate defining an installation chamber; and a shielding member installed within the installation chamber of the partition member and including:

elastic contacts extending from lateral sides of the partition member, the elastic contacts exposed from left and right openings of the installation chamber and pressing on the left and right side walls of the accommodation space;

a front wall, the elastic contacts including a first elastic contact connected to edges of the front wall of the shielding member;

a bottom wall, the elastic contacts including a second elastic contact connected to edges of the bottom wall of the shielding member; and a top wall, the elastic contacts including a third elastic contact connected to edges of the top wall of the shielding member.

2. The connector housing assembly according to claim 1, wherein:

the first elastic contact seals horizontally extending gaps between the top plate of the partition member and the left and right side walls of the accommodation space;

the second elastic contact seals horizontally extending gaps between the bottom plate of the partition member and the left and right side walls of the accommodation space; and the third elastic contact seals vertically extending gaps between the front plate of the partition member and the left and right side walls of the accommodation space.

3. The connector housing assembly according to claim 1, wherein each elastic contact defines a pair of elastic tabs.

4. The connector housing assembly according to claim 1, wherein the top plate of the partition member defines a cantilever upper latch, the top wall of the shielding member being continuous and uninterrupted in an area of the upper latch.

5. The connector housing assembly according to claim 4, wherein the top wall of the shielding member defines an upper protrusion extending toward the top plate of the partition member in an area proximate a free end portion of the upper latch for increasing a distance between the free end portion of the upper latch and the top wall of the shielding member.

6. The connector housing assembly according to claim 5, wherein the upper latch extends into the upper insertion chamber for locking a first mating connector within the upper insertion chamber.

7. The connector housing assembly according to claim 5, wherein the upper protrusion includes a rectangular shaped first upper protrusion and two bar shaped second upper protrusions formed on the top wall, with the first upper protrusion located at a middle of the top wall, and the two second upper protrusions located on respective left and right sides of the first upper protrusion.

8. The connector housing assembly according to claim 7, wherein the bottom plate of the partition member defines a cantilever lower latch, the bottom wall of the shielding member being continuous and uninterrupted in an area of the lower latch.

9. The connector housing assembly according to claim 8, wherein the bottom wall of the shielding member defines a lower protrusion extending toward the bottom plate of the partition member in an area proximate a free end portion of the lower latch for increasing a distance between the free end portion of the lower latch and the bottom wall of the shielding member.

10. The connector housing assembly according to claim 9, wherein the lower latch extends into the lower insertion chamber for locking a second mating connector within the lower insertion chamber.

11. The connector housing assembly according to claim 10, wherein the lower protrusion includes a rectangular shaped first lower protrusion and two bar shaped second lower protrusions formed on the bottom wall, with the first lower protrusion located at a middle of the bottom wall, and the two second lower protrusions located on respective left and right sides of the first lower protrusion.

12. The connector housing assembly according to claim 1, wherein a rear part of the top wall of the shielding member is bent outwardly and defines protruding bulges for contacting the top plate of the partition member.

13. The connector housing assembly according to claim 12, wherein a rear part of the bottom wall of the shielding member is bent outwardly and defines protruding bulges for contacting the bottom plate of the partition member.

14. The connector housing assembly according to claim 1, wherein the partition member comprises a plurality of connecting tongues extending outwards from edges of left and right sides of the top plate and the bottom plate, the plurality of connecting tongues inserted through holes formed in the left and right side walls of the accommodation space for fixing the partition member to the housing.

15. The connector housing assembly according to claim 1, wherein the housing defines a plurality of accommodation spaces arranged in a row along the transverse direction of the housing, and a plurality of partition members are arranged in a row along the transverse direction of the housing and divide the row of accommodation spaces into a row of upper insertion chambers and a row of lower insertion chambers.

16. The connector housing assembly according to claim 15, wherein the housing includes a top wall, a bottom wall, a pair of side walls and at least one separation wall, the at least one separation wall dividing an internal space of the housing into the plurality of accommodation spaces.

17. The connector housing assembly according to claim 16, wherein the connector housing assembly includes electromagnetic shielding spring tabs arranged on four peripheral walls of a front side of the housing.

18. A connector housing assembly, comprising:

a housing defining an accommodation space having a left side wall and a right side wall arranged opposite each other in a transverse direction of the housing;

a partition member inserted into the accommodation space and dividing the accommodation space into an upper insertion chamber and a lower insertion chamber, the partition member including a plurality of connecting tongues extending outwards from edges of left and right sides thereof, the plurality of connecting tongues inserted through holes formed in the left and right side walls of the accommodation space for fixing the partition member to the housing; and a shielding member installed within the partition member and including elastic contacts extending from lateral sides of the partition member, the elastic contacts pressing on the left and right side walls of the accommodation space.

19. A connector housing assembly, comprising:

a housing including a top wall, a bottom wall, a pair of sidewalls arranged opposite one another other in a transverse direction of the housing, and a separation wall extending between the top wall and the bottom wall;

at least one first partition member inserted into the housing between one of the pair of sidewalls and the separation wall;

at least one second partition member inserted into the housing between the other one of the pair of sidewalls and the separation wall, the at least one first partition member and the at least one second partition member separated from one another in a transverse direction of the housing by the separation wall;

at least one first shielding member installed within the at least one first partition member and including elastic contacts extending from lateral sides of the at least one first partition member; and at least one second shielding member, discrete from the first shielding member, installed within the at least one second partition member and including elastic contacts extending from lateral sides of the at least one second partition member.

20. The connector housing assembly according to claim 19, wherein the at least one first partition member includes a top plate and the bottom plate extending at least a first distance into the housing in an longitudinal direction, the at least one first shielding member extending into the housing a second distance, less than the first distance, in the longitudinal direction such that the at least one first partition member covers the at least one first shielding member in the longitudinal direction.

* * * * *